United States Patent [19]

Staran et al.

[11] Patent Number: 4,642,941

[45] Date of Patent: Feb. 17, 1987

[54] FLEX DRIVE WINDOW REGULATOR SYSTEM

[75] Inventors: Michael E. Staran, Bloomfield Hills; Ronald B. Czulinski, Warren; Albert J. Hammond, West Bloomfield, all of Mich.

[73] Assignee: Ferro Manufacturing Corporation, Southfield, Mich.

[21] Appl. No.: 773,465

[22] Filed: Sep. 9, 1985

[51] Int. Cl.[4] ..... E05F 11/48

[52] U.S. Cl. ..... 49/352; 74/89.21

[58] Field of Search ..... 49/352; 242/117; 74/89.12

[56] References Cited

U.S. PATENT DOCUMENTS

| | | | |
|---|---|---|---|
| 4,246,726 | 1/1981 | Breqz et al. | 49/352 X |
| 4,364,202 | 12/1982 | Zavatkay | 49/352 |
| 4,468,887 | 9/1984 | Koch | 49/352 |

FOREIGN PATENT DOCUMENTS

| | | | |
|---|---|---|---|
| 1951710 | 4/1971 | Fed. Rep. of Germany | 49/352 |

*Primary Examiner*—Kenneth Downey

*Attorney, Agent, or Firm*—Stephenson and Boller

[57] ABSTRACT

The invention relates to a window regulator comprising a generally flat tape having sufficient flexibility to follow a curved path of substantial radius but being sufficiently rigid to transmit in compression, when guided in a functionally rigid track, sufficient force to regulate a vehicle window, said tape having at one side a series of transversely extending substantially rack shaped teeth, the ends of said teeth being spaced from the edges of said tape to leave flat side guide portions, and a functionally rigid but bendable track comprising a channel having reversely bent guide flanges spaced to receive the toothed portion of said rack.

A drive pinion is in mesh with the rack teeth, and preferably the track is curved to present a concavity to the drive pinion.

3 Claims, 2 Drawing Figures

FLEX DRIVE WINDOW REGULATOR SYSTEM

SUMMARY OF THE INVENTION

The invention relates to an improved window regulator in which one end of a flexible tape is connected to the bottom edge of a window, and the tape is provided with a functionally rigid but bendable track along which it longitudinally is movable. Co-pending application Ser. No. 517,979 filed July 28, 1983, now U.S. Pat. No. 4,592,245, assigned to the assignee of this application, discloses another form of a window regulator utilizing a flexible tape with rack teeth.

The tape is formed of a plastic material which in tape form is sufficiently flexible to conform to portions of the track curved on a substantial radius, but rigid enough to transmit sufficient force in tension and compression to regulate the vehicle window.

The track is formed from an elongated metal strip doubled along its longitudinal center line to provide a support stem, and the edges of the strip are bent to extend outwardly from the stem to form the inner wall of a channel. The edge portions of the strip are then bent reversely to provide guide flanges which are spaced from the inner wall and the edges of guide flanges are spaced apart to provide a longitudinally extending opening into a tape receiving channel.

The tape is formed of a plastic material which in the dimensions employed is sufficiently flexible to follow track portions curved to a substantial radius, but sufficiently rigid to transmit enough force in compression and tension to regulate vehicle windows. Many plastic materials are available for this, among which are nylon 11 and acetyl polymers.

The tape is relatively thin and has a width/thickness ratio of approximately 10/1. The edge portions of the tape are received in guide slots provided between the inner wall of the channel and the reversely bent guide flanges of the track.

Extending along the central portion of the tape is a series of rack teeth, which may extend outwardly between the spaced apart confronting edges of the guide flanges.

In compression, the guide flanges prevent buckling of the tape, and compel it to conform to the track while sliding therealong.

In use the track is bent to the required configuration and is fastened to rigid stationary support structure. One end of the tape is secured to the lower edge of a vehicle window, and movement of the tape along the track raises or lowers the window.

In modern designs of vehicles it is quite common to require the window to move along a path inclined substantially from the vertical and the track as provided herein may have a correspondingly inclined upper portion.

COMPLETE DESCRIPTION

Figure 1:
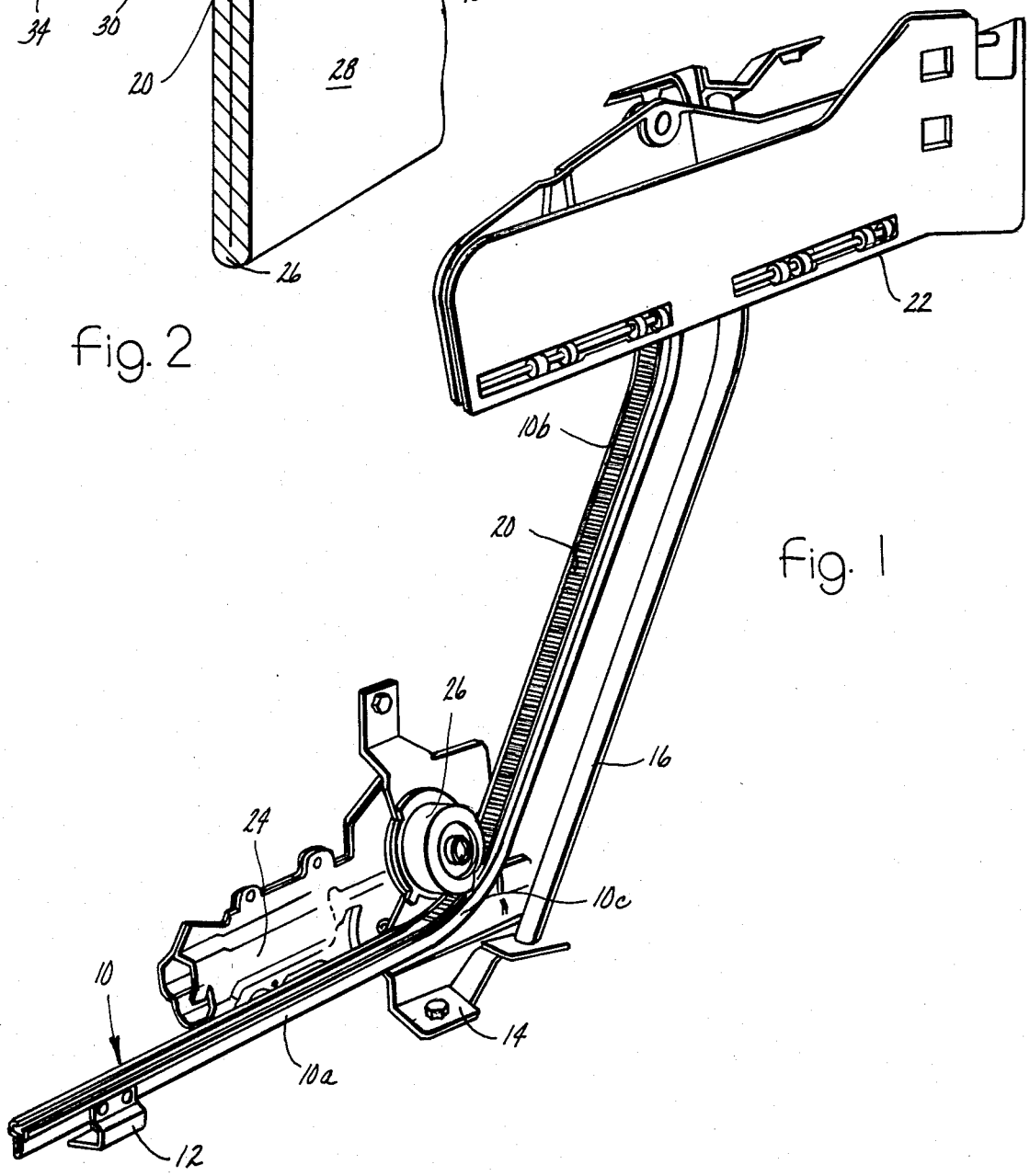
FIG. 1 is a perspective view of the track, tape, support structure, and window connection.

As best seen in FIG. 1, a bendable but functionally rigid track 10 is mounted below a window opening in a motor vehicle and secured in place by brackets 12, 14 and to rigid support structure 16 mounted within the space below the window.

As shown, a section 10*a* of the track may extend substantially horizontally, while another section 10*b* may extend generally upwardly but inclined substantially from the vertical, as shown. The junction between the track sections 10*a* and 10*b* is shown at 10*c*, and may include an arcuately curved portion having a relatively large radius of curvature.

The tape 20, which will be described in detail, is movable along the track, and one end of the tape is connected to a window fixture 22, so that as the tape is moved, the lower edge of the window is moved along a path parallel to the rigid support 16. Details of the fixture 22 form no part of the present invention.

For regulation of the window between open and closed position, there is illustrated a drive assembly 24 which includes a reversible electric motor connected to a drive pinion (not shown) within a pinion housing 26 having an opening at its lower side to permit the pinion to drive the tape in either direction to move the window to open or close the window opening.

Figure 2:
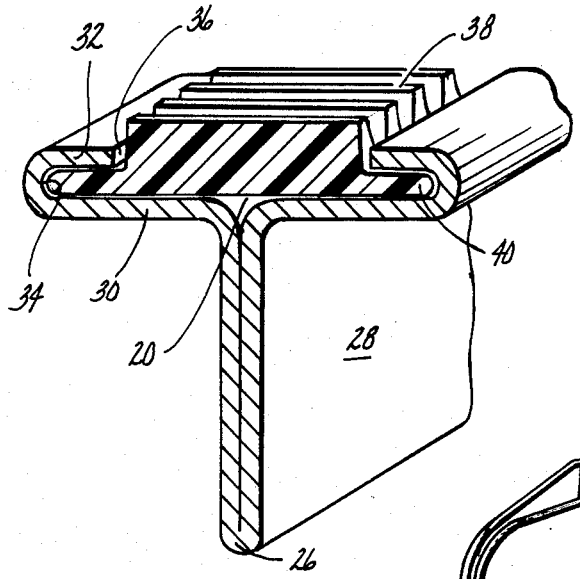
FIG. 2 is an enlarged perspective, partly in section, of the track and tape.

Referring now to FIG. 2, the track is formed from an elongated metal strip by bending at 26 to form a support stem 28 of double thickness. Edge portions of the strip are bent outwardly to form the inner wall 30 of a tape-receiving channel. The extreme edge portions of the strip are reversely bent as shown to form confronting guide flanges 32, spaced from wall 30 to provide tape guide slots 34. The confronting edges 36 of the strip are spaced apart to provide an opening therebetween into the channel through which the tape 20 is exposed or through which teeth on the tape extend.

The track is formed of thin metal which in the configuration illustrated may be bent, as at the arcuate bend 10*c*, but when fixed by brackets 12, 14 and fixedly attached to rigid support 16, retains its bent configuration in use. This capability is referred to a functional rigidity, which is sufficient to constrain the flexible tape to conform to the track configuration, both in compression and tension between the drive pinion and the window fixture.

The tape 20, as best seen in FIG. 2, is formed of a suitable plastic material, such as a nylon or acetyl polymer and comprises an essentially flat strip having intermediate its edge portions a longitudinally extending series of rack teeth 38.

The flexible strip has edge portions 40 which are received in the guide slots 34 in the track. The strip 40 has a width to thickness ratio on the order of 10/1, so that it is fairly flexible transversely of its thickness, but substantially inflexible transversely of its width.

The edge portions 40 of the strip are guided in slots 34, which prevents buckling of the tape under compression.

In addition, it is to be noted that in the illustrated embodiment of the invention the drive pinion is located at a point where the track is arcuately bent to present a concavity to the pinion. As a result, teeth 38 of the tape at this point are arranged in a circular arc and are equivalent to the teeth of an internal gear having the pitch radius determined by the radius of curvature of the track. Accordingly, rack teeth 38 are modified to have the tooth profile proper for such an internal gear. Of course, if the drive pinion is located at a straight section of track the rack teeth have the usual flat or planar sides.

What is claimed is:

1. A window regulator comprising a functionally rigid elongated track formed of one integral member which is bendable into a desired configuration but remains rigidly in bent position in use, said track comprising an elongated guide channel having an inner wall and edge portions reversely bent to provide confronting guide flanges parallel to but spaced from said inner wall to form guide slots, the edges of said guide flanges being spaced apart to provide a longitudinally extending lateral opening into said channel, a normally flat flexible tape having a width to thickness ratio on the order of 10/1, said tape being positioned in said channel and having edge portions slidable in said slots and confined between said guide flanges, said tape having a series of substantially rack shape teeth extending longitudinally from the outer side of said tape and projecting through said lateral opening, and a drive pinion in mesh with said teeth.

2. A regulator as defined in claim 1 in which said track is bent at the location of said drive pinion to present a concavity to said pinion.

3. A regulator as defined in claim 1 in which said track is formed of a sheet metal strip having its longitudinally extending median portion doubled to form a support stem, and having its edge portion bent to extend laterally outwardly in opposite directions from said stem to form said channel, inner wall and then reversely bent to provide said inwardly extending confronting guide flanges spaced from said channel inner wall to form said guide slots therewith, the confronting edges of said guide flanges being spaced apart as aforesaid.

* * * * *